US011396085B2

(12) United States Patent
Stark et al.

(10) Patent No.: US 11,396,085 B2
(45) Date of Patent: Jul. 26, 2022

(54) ADAPTER FOR COUPLING ABRASIVE ELEMENTS TO A FLOOR FINISHING MACHINE

(71) Applicant: DIAMOND PRODUCTIONS LTD., Montreal (CA)

(72) Inventors: Harvey Stark, Montreal (CA); Pavel Ikonomov, Laval (CA)

(73) Assignee: Diamond Productions Ltd., Montreal (CA)

( * ) Notice: Subject to any disclaimer, the term of this patent is extended or adjusted under 35 U.S.C. 154(b) by 189 days.

(21) Appl. No.: 15/705,947

(22) Filed: Sep. 15, 2017

(65) Prior Publication Data

US 2019/0084126 A1 Mar. 21, 2019

(51) Int. Cl.
*B24D 7/06* (2006.01)
*B24B 7/18* (2006.01)

(52) U.S. Cl.
CPC ..... *B24D 7/066* (2013.01); *B24B 7/186* (2013.01)

(58) Field of Classification Search
CPC ..... B24D 7/066; B24B 7/186; B24B 23/005; B24B 23/02; B24B 23/04
USPC ..... 451/353, 350, 359, 548
See application file for complete search history.

(56) References Cited

U.S. PATENT DOCUMENTS 1,693,163 A * 11/1928 Schacht ..... B24B 23/028 451/511
3,098,329 A * 7/1963 Doran ..... B24B 7/186 299/41.1
3,745,719 A 7/1973 Oswald
5,058,909 A * 10/1991 Rudolf ..... B24B 23/02 279/8
5,470,272 A * 11/1995 Kikuchi ..... B24B 23/04 451/344
5,567,503 A * 10/1996 Sexton ..... B24D 3/30 428/323
5,605,493 A 2/1997 Donatelli et al.
5,788,224 A * 8/1998 Platt ..... E04H 17/1421 256/66
6,004,194 A * 12/1999 Hild ..... B24B 45/006 451/344
6,425,169 B1 * 7/2002 Briscoe ..... A47L 11/164 29/90.01
6,796,888 B2 * 9/2004 Jasch ..... B23B 31/008 451/342
7,186,172 B1 * 3/2007 Ohata ..... B24B 23/02 451/342
7,506,644 B2 * 3/2009 Park ..... B24B 41/047 125/22
7,587,779 B2 * 9/2009 Walz ..... A47L 11/283 15/180
7,713,109 B2 * 5/2010 Estes ..... B24B 45/006 451/56

(Continued)

*Primary Examiner* — Monica S Carter
*Assistant Examiner* — Marcel T Dion
(74) *Attorney, Agent, or Firm* — Bradley J. Thorson; DeWitt LLP

(57) ABSTRACT

An adapter clip to be used to mate an abrasive support plate to the drive plate of a floor finishing machine used to grind and/or polish concrete and stone flooring is designed with an internal aperture shaped to conform to and clip onto a protuberance on an upper surface of an abrasive support plate and an external shape to mate with a mounting recess formed on the machine's drive plate.

18 Claims, 6 Drawing Sheets

(56) References Cited

U.S. PATENT DOCUMENTS

| | | | | |
|---|---|---|---|---|
| 8,029,340 | B2 * | 10/2011 | Henning | B24B 23/02 451/359 |
| 2003/0129933 | A1 * | 7/2003 | Wendt | B24B 23/02 451/342 |
| 2004/0005851 | A1 * | 1/2004 | MacKay | B24B 23/022 451/359 |
| 2008/0176498 | A1 * | 7/2008 | Rossi | B24B 7/186 451/508 |
| 2008/0207102 | A1 * | 8/2008 | Sjolander | B24B 3/33 451/548 |
| 2010/0175237 | A1 * | 7/2010 | Luk-Tung | B24D 7/066 29/243 |
| 2011/0195644 | A1 * | 8/2011 | Gallup | B24B 41/066 451/442 |
| 2011/0223845 | A1 * | 9/2011 | Van Der Veen | B24B 7/22 451/548 |
| 2015/0245759 | A1 | 9/2015 | Stark | |
| 2017/0348780 | A1 * | 12/2017 | Zhang | B24B 23/04 |
| 2021/0131533 | A1 * | 5/2021 | Mesinovic | B24B 7/186 |

* cited by examiner

ADAPTER FOR COUPLING ABRASIVE ELEMENTS TO A FLOOR FINISHING MACHINE

CROSS-REFERENCED TO RELATED APPLICATIONS

Not applicable

STATEMENT REGARDING FEDERALLY SPONSORED RESEARCH OR DEVELOPMENT

Not applicable

BACKGROUND OF THE INVENTION

I. Field of the Invention

The present invention relates generally to motor driven machines for grinding and polishing concrete or stone floors and, more particularly, to devices for mating abrasive elements to a variety of existing floor finishing machines in the field.

II. Discussion of the Prior Art

As is described in U.S. Pat. No. 5,605,493 to Donatelli, motor driven machines for grinding, polishing and buffing concrete, terrazzo and other stone floors generally comprise a motor driven driver disc on the underside of which are removably attached one or more plates or pads having abrasive members on their underside for engaging the floor surface. Applicant's published U.S. application 2015/0245759A1 describes the construction of an abrasive pad and its mode of attachment to a driver disc. The pad 16 is designed to mate with a driver disc having a specific key-hole/pocket arrangement.

Applicant corporation is in the business of providing diamond abrasive pads for use on floor finishing equipment and, because different manufacturers of floor finishing machines have not standardized on a single mode of replaceably attaching abrasive pads to machine driver plates, a need exists for a simple, inexpensive mode of adapting applicant's abrasive pads to a variety of different driver plates that may be encountered on existing floor finishing machines in the field. The present invention meets this need.

SUMMARY OF THE INVENTION

The present invention relates to apparatus for removably affixing floor finishing abrasives to a drive plate of a floor finishing machine. An abrasive attachment plate having at least one abrasive element affixed to a first major surface thereof has a protuberance of a predetermined shape configuration projecting outward from a second major surface thereof. Completing the invention is an adapter clip having an interior aperture for mating with the predetermined shape of the protuberance and an exterior shape adapted to mate with a shape of a recess on the drive plate of the floor finishing machine.

A variety of such clips are produced having an interior aperture matching the shape of the protuberance employed on the attachment plate and having an exterior shape that mates to the variety of attachment grooves on the drive plates of machines offered by different manufacturers.

BRIEF DESCRIPTION OF THE DRAWINGS

The foregoing features, objects and advantages of the present invention will become apparent to those skilled in the art from the following detailed description of a preferred embodiment, especially when considered in conjunction with the accompanying drawings in which.

DESCRIPTION OF THE PREFERRED EMBODIMENT

Figure 1A:
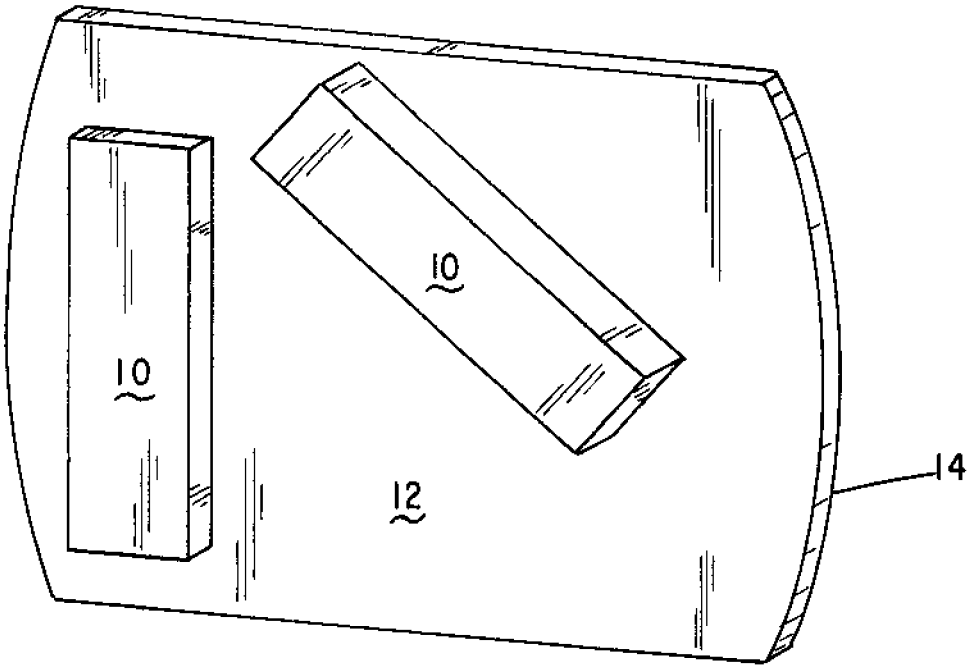
FIG. 1A is a perspective bottom view of an abrasive attachment plate.
Figure 1B:
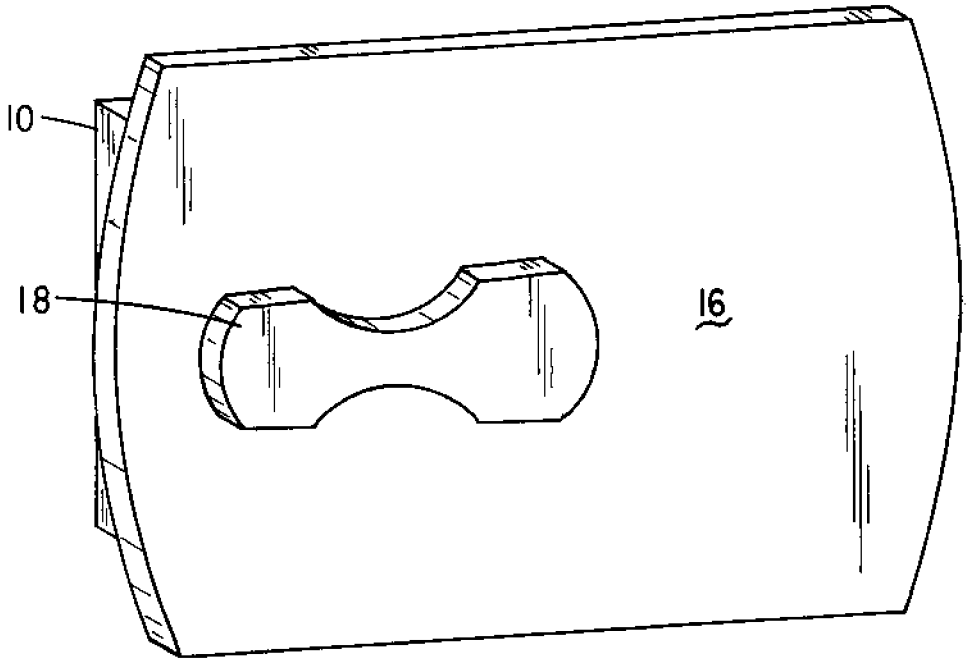
FIG. 1B is a perspective top view thereof.

This description of the preferred embodiments is intended to be read in connection with the accompanying drawings, which are to be considered part of the entire written description of this invention. In the description, relative terms such as "lower", "upper", "horizontal", "vertical", "above", "below", "up", "down", "top" and "bottom" as well as derivatives thereof (e.g., "horizontally", "downwardly", "upwardly", etc.) should be construed to refer to the orientation as then described or as shown in the drawings under discussion. These relative terms are for convenience of description and do not require that the apparatus be constructed or operated in a particular orientation. Terms such as "connected", "connecting", "attached", "attaching", "join" and "joining" are used interchangeably and refer to one structure or surface being secured to another structure or surface or integrally fabricated in one piece, unless expressively described otherwise.

Figure 2A:
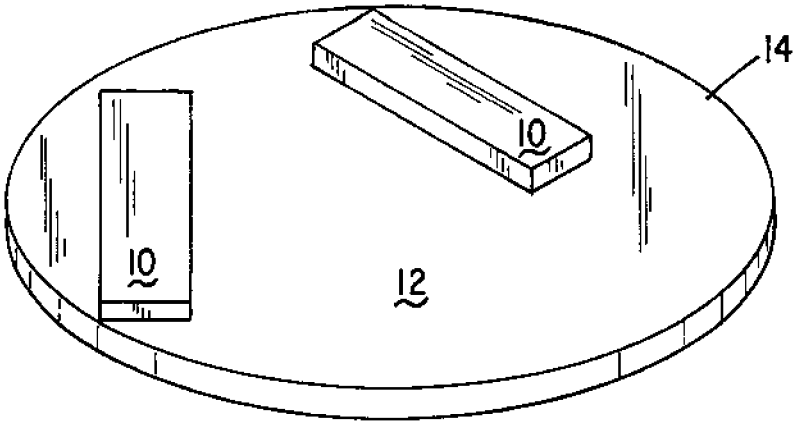
FIG. 2A is an abrasive attachment plate of a different (circular) shape.

FIGS. 1A, 1B, 2A and 2B illustrate representative abrasive attachment plates for use on either riding or walk-behind floor finishing machines. The bottom views of FIGS. 1A and 2A show diamond abrasive members 10 bonded to the undersurface 12 of attachment plates 14. The upper surface 16 includes an exemplary protuberance 18 having a predetermined shape configuration projecting outward from the plate surface 16. The predetermined shape of the protuberance shown is bilaterally symmetrical about its longitudinal axis and exhibits a somewhat hourglass shape, but this shape is somewhat arbitrary as far as the invention is concerned.

Figure 3:
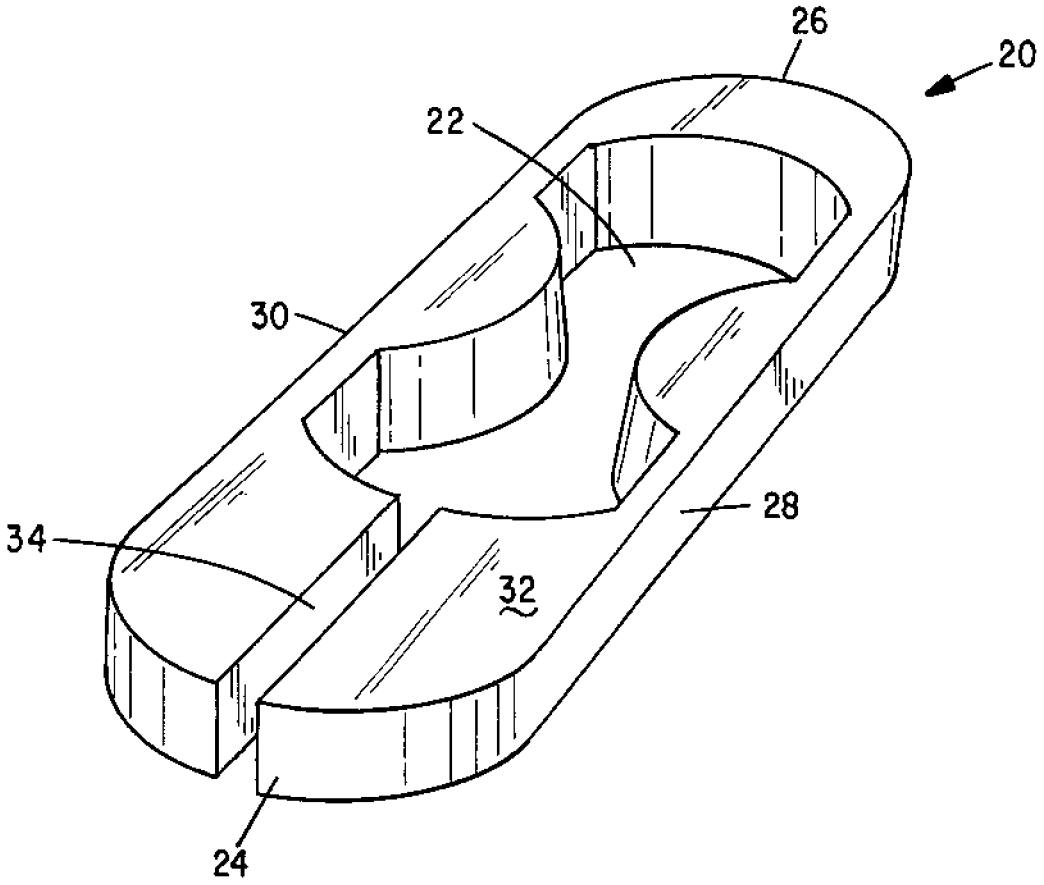
FIG. 3 is a perspective view of an adapter clip in accordance with the present invention.

Shown in FIG. 3 is a perspective view of an adapter clip 20 having an interior aperture 22 specifically shaped to mate with the predetermined arbitrary shape of a protuberance 18 on the upper surface 16 of the attachment plate. The interior aperture of the adapter clip shown in the drawings is also bilaterally symmetrical about a central axis and the exterior shape is beveled along the length dimension thereof.

The adapter clip 20 is preferably fabricated from, a resilient material either a metal or a suitable high-temperature plastic such as Vespel® or Torlon® when it is recognized that the attachment plate 14 and the protuberance 18 become quite hot due to the friction when the abrasive bars 10 are made to abrade the cement or stone flooring during use of the floor finishing machine. Vespel plastic is a non-melting polyimide that can withstand repeated heating up to 300° C. without altering its thermal or mechanical properties. Torlon is another high temperature plastic that can serve as an effective alternative to metal in high temperature friction and wear applications. The plastic employed will preferably have a temperature in excess of 390° F. without becoming distorted. It is to be understood that the material of the clip need not need limited to metal or plastic, but can be of any material meeting the performance needs.

Figure 4:
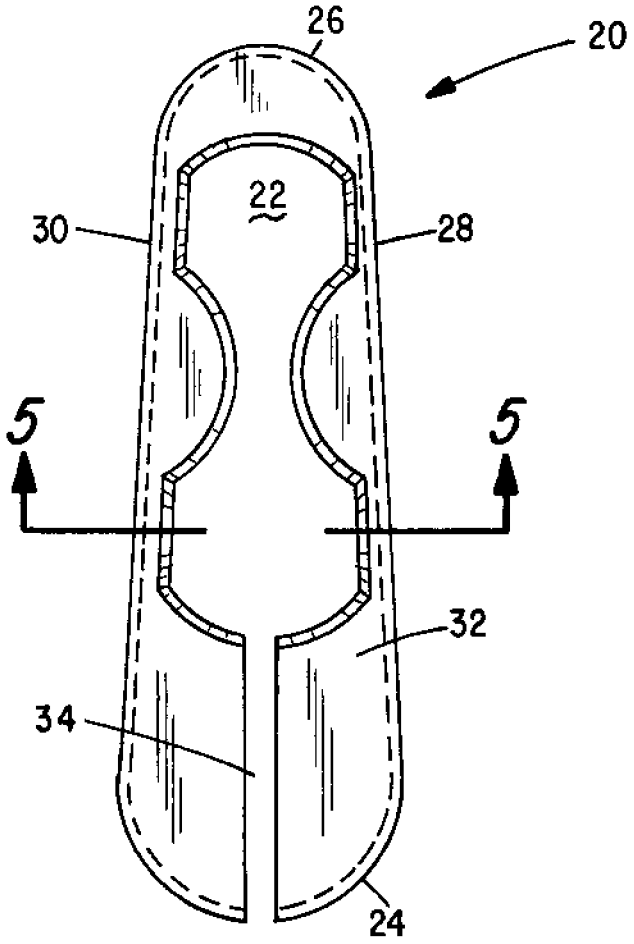
FIG. 4 is a top view thereof.
Figure 5:
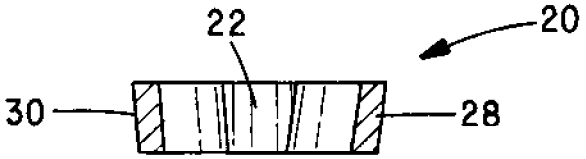
FIG. 5 is a cross-sectional view taken along the line 5-5 in FIG. 4.

As can best be seen in FIG. 4, the exterior profile of the clip 20 is somewhat wedge-shaped having first and second ends 24 and 26 of radii R1 and R2, respectively, where R1 is greater than R2. As seen in the cross-sectional view of FIG. 5, the sides of the clip 28 and 30 are also beveled so as to slope slightly downward and inward from a top surface 32 of the adapter clip 20.

A central longitudinal slot 34 through its thickness dimension extends from the end 24 of radius R1 to the interior aperture 22. This allows the aperture 22 of the clip to be expanded to fit the protuberance within the aperture 22 and allows the clip 20 to snap onto a protuberance 18 and become releasably clamped thereon due to the resiliency of the material from which the adapter clip 20 is made.

Figure 6A:
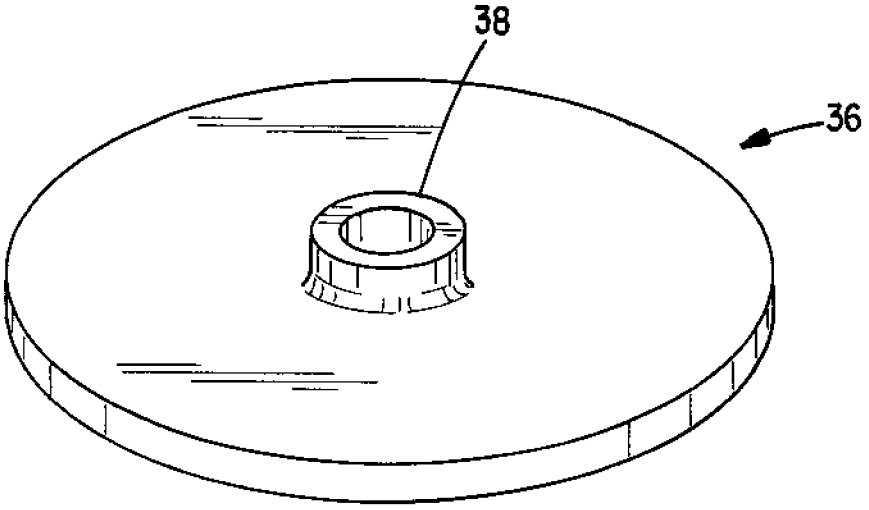
FIG. 6A is a perspective view of a drive plate for a floor finishing machine.

FIG. 6A represents a perspective view of a drive plate for a floor finishing machine and is indicated generally by numeral 36. It includes a central socket 38 adapted to fit onto a shaft of a motor or to an auxiliary shaft driven by a motor to thereby spin the disc.

Figure 6B:
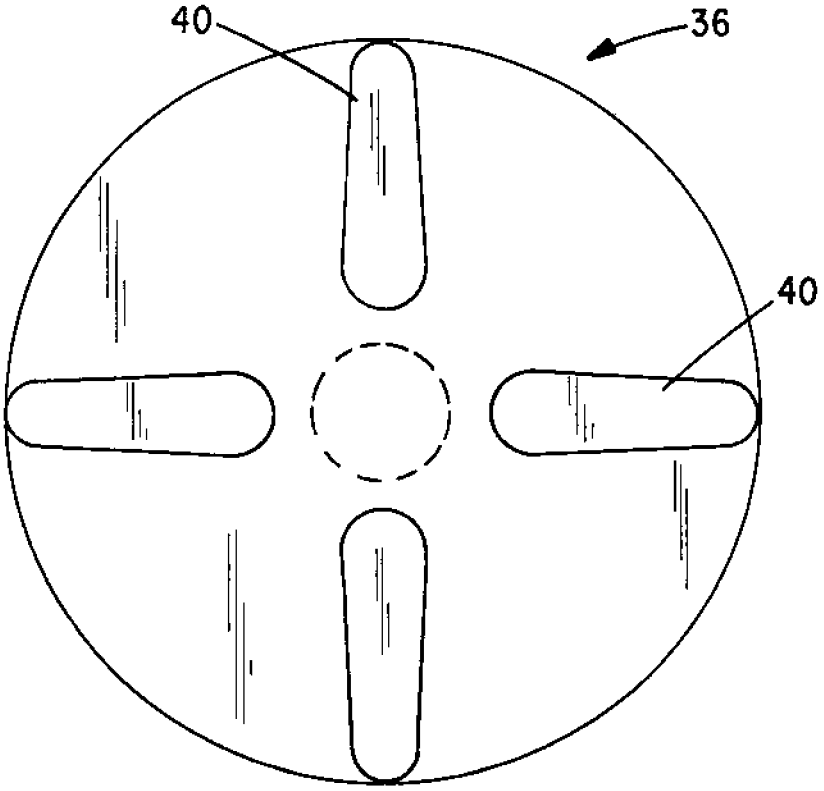
FIG. 6B is a bottom view of the drive plate of FIG. 6A.

FIG. 6B is a bottom view of the drive plate 36 and is seen to include a plurality of grooves whose shape is adapted to mate with the exterior shape of the adapter clip 20. Now, when the adapter clip is fitted onto the protuberance 18 of the attachment plate 14 and the end 26 of the adapter clip is fitted into the wider end of the groove 40 of the machine's drive plate 36 and pushed radially outward, the clip becomes locked in the groove 40 to retain the attachment plate onto the driven drive plate. It is to be understood that the adapter clip may have any number of different external shapes to conform to recess shapes on a variety of existing floor finishing machine drive plates being manufactured and sold and is not to be limited to that shown in FIG. 4 hereof.

Figure 2B:
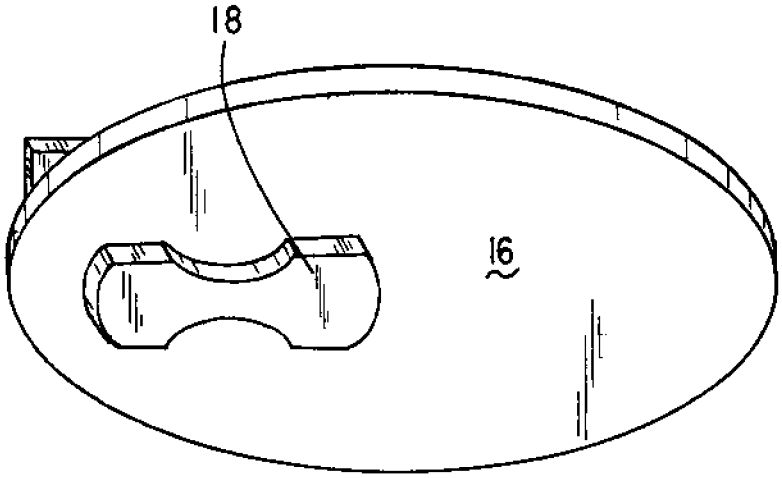
FIG. 2B is a perspective top view thereof.
Figure 7:
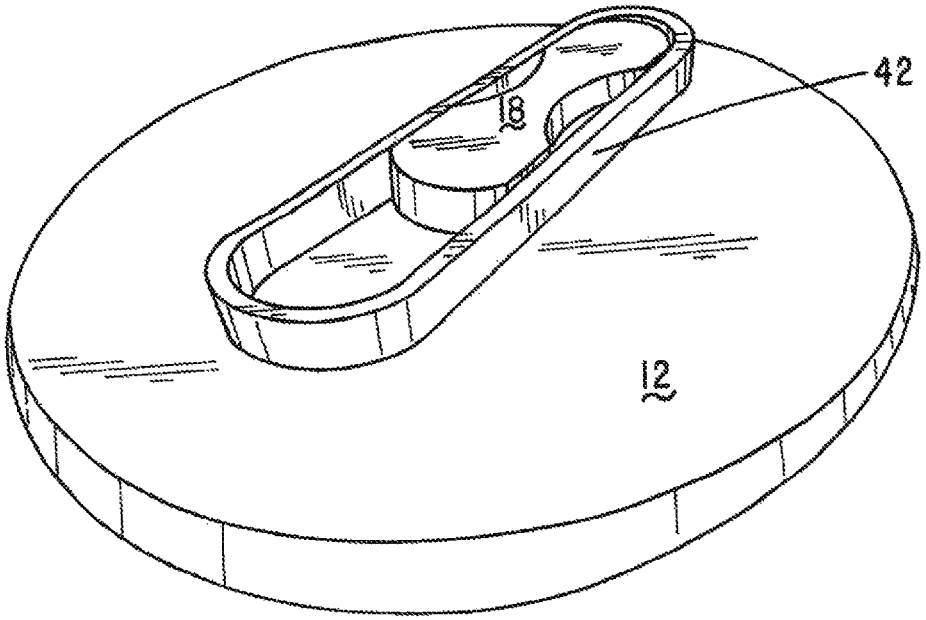
FIG. 7 is a perspective view of an alternative clip embodiment.

FIG. 7 is a perspective view of an alternative clip configuration 42 assembled onto a protuberance 18 of an abrasive plate 12 like that shown in FIG. 2B. Again, the interior aperture of the clip 42 is downwardly and inwardly beveled so as to conform to the shape of the protuberance 18 when positioned as shown in FIG. 7 and its exterior shape is again wedge-shaped and designed to fit into and be removably retained within a recess, like recess 40 on a floor machine's drive plate 36 shown in FIG. 6B.

This invention has been described herein in considerable detail in order to comply with the patent statutes and to provide those skilled in the art with the information needed to apply the novel principles and to construct and use embodiments of the example as required. However, it is to be understood that the invention can be carried out by specifically different devices and that various modifications can be accomplished without departing from the scope of the invention itself.

What is claimed is:

1. Apparatus for removably affixing floor finishing abrasives to a floor finishing machine comprising:

a) a drive plate operably coupled to the floor finishing machine, the drive plate having an outer peripheral edge and at least one oblong and curvilinear recess in a floor facing surface, said at least one oblong and curvilinear recess in the floor facing surface having an inner wall defining a first narrower rounded closed end adjacent the outer peripheral edge of the drive plate and a first wider rounded closed end further away from the outer peripheral edge of the drive plate than the first narrower rounded closed end;

b) an attachment plate having at least one abrasive element affixed to a first major surface thereof and a protuberance of a predetermined oblong and curvilinear shape configuration projecting outwardly from a second major surface thereof, said predetermined oblong and curvilinear shape configuration comprising an outer wall defining a second narrower rounded end and a second wider rounded end, wherein the protuberance has an exterior neck portion between the second narrower rounded end and the second wider rounded end both said second narrower rounded end and said second wider rounded end positioned immediately adjacent the second major surface, wherein said protuberance is adapted to be (i) inserted into the at least one recess in the floor facing surface with the second narrower rounded end facing the first narrower rounded closed end, and (ii) pushed radially outwardly within the at least one recess toward the first narrower rounded closed end; and c) an adapter clip having an exterior wall adapted to be received within said at least one recess in the floor facing surface of the drive plate, said adapter clip having an interior aperture with an interior wall, wherein said interior wall of the aperture has an interior neck portion matching the exterior neck portion of the protuberance, said aperture adapted to receive the protuberance such that the interior wall of the aperture engages the outer wall of the protuberance, and wherein said protuberance and said adapter clip are adapted to be inserted together into the at least one recess in the floor facing surface with the second narrower rounded end facing the first narrower rounded closed end.

2. The apparatus of claim 1 wherein the inner wall of the at least one recess in the floor facing surface of the drive plate further comprises a first side section extending between the first narrower rounded closed end and the first wider rounded closed end, a second side section extending between the first narrower rounded closed end and the first wider rounded closed end, and wherein said first side section and said second side section diverge from each other as they extend from the first rounded closed narrower end to the first wider rounded closed end.

3. The apparatus of claim 2 wherein the outer wall of the protuberance further comprises a third side section extending from the second narrower rounded end, a fourth side section extending from the second narrower rounded end, and wherein said third side section and said forth side section diverge from each other as they extend from the second narrower rounded end.

4. The apparatus of claim 3 wherein said outer wall of the protuberance further comprises, a fifth side section and a sixth side section each extending between the interior neck portion and the second wider rounded end, and wherein the fifth side section and the sixth side section diverge from each other as they extend from the interior neck portion toward the second wider rounded end.

5. The apparatus of claim 1, wherein the protuberance and adapter clip are adapted to be pushed radially outwardly toward the first narrower rounded closed end causing the inner wall, the outer wall and the adapter clip to cooperate to secure the attachment plate to the drive plate.

6. The apparatus of claim 5 wherein exterior wall of the clip is beveled.

7. The apparatus of claim 5 wherein the interior wall of the clip is beveled.

8. The apparatus of claim 7 wherein the protuberance is beveled.

9. The apparatus of claim 1 wherein the protuberance is beveled.

10. The apparatus of claim 1 wherein said at least one recess in the floor facing surface is beveled.

11. Apparatus for removably affixing floor finishing abrasives to a floor finishing machine comprising:

a) a drive plate operably coupled to the floor finishing machine, the drive plate having an outer edge and at least one recess in a floor facing surface, said at least one oblong and curvilinear recess in the floor facing surface having an inner wall defining a first narrower rounded closed end adjacent the outer edge of the drive plate and first wider rounded closed end further away from the outer edge of the drive plate than the first narrower rounded closed end;

b) an attachment plate having at least one abrasive element affixed to a first major surface thereof and a protuberance of a predetermined oblong and curvilinear shape configuration projecting outward from a second major surface thereof, said predetermined oblong and curvilinear shape configuration comprising an outer wall defining a second narrower rounded end and a second wider rounded end wherein said outer wall of the protuberance has an exterior neck portion between the second narrower rounded end and the second wider rounded end, both said second narrower rounded end and said second wider rounded end positioned immediately adjacent the second major surface; and c) an adapter clip having an exterior wall adapted to be received within said at least one recess in the floor facing surface of the drive plate, said adapter clip having an interior aperture with an interior wall, wherein said interior wall of the aperture has an interior neck portion matching the exterior neck portion of the protuberance, said aperture adapted to receive the protuberance such that the interior wall of the aperture engages the outer wall of the protuberance, wherein said protuberance and said adapter clip are adapted to be inserted together into the at least one recess in the floor facing surface with the second narrower rounded end facing the first narrower rounded closed end and pushed radially outwardly toward the first narrower rounded closed end causing the inner wall, the outer wall and the adapter clip to cooperate to secure the attachment plate to the drive plate.

12. The apparatus as in claim 11 wherein the interior aperture of the adapter clip is bilaterally symmetrical about a central axis of the adapter clip and the exterior shape is tapered along a length dimension and having a third narrower rounded end and a third wider rounded end.

13. The apparatus as in claim 12 wherein the adapter clip is tapered in its thickness dimension.

14. The apparatus as in claim 11 wherein the adapter clip is metal.

15. The apparatus as in claim 11 wherein the adapter clip is a plastic having a service temperature greater than 390° F.

16. The apparatus as in claim 11 wherein the adapter clip includes a slot through a thickness dimension thereof extending longitudinally from the interior aperture to one end of the adapter clip whereby the interior aperture changes in size upon being forced onto the protuberance.

17. Apparatus for removably affixing floor finishing abrasives to floor finishing machine comprising:

a) a drive plate operably coupled to the floor finishing machine, the drive plate having an outer peripheral edge and at least one oblong and curvilinear recess in a floor facing surface, said at least one oblong and curvilinear recess in the floor facing surface having a beveled inner wall defining a first narrower rounded closed end adjacent the outer peripheral edge of the drive plate and a first wider rounded closed end further away from the outer edge of the drive plate than the first narrower rounded closed end, wherein the inner wall further comprises a first side section extending between the first narrower rounded closed end and the first wider rounded closed end, a second side section extending between the first narrower rounded closed end and the first wider rounded closed end, and wherein said first side section and said second side section diverge from each other at a first angle as they extend from the first narrower rounded closed end to the first wider rounded closed end;

b) an attachment plate having at least one abrasive element affixed to a first major surface thereof and a protuberance of a predetermined oblong and curvilinear shape configuration projecting outward from a second major surface thereof, said oblong and curvilinear predetermined shape configuration defined by a beveled outer wall defining a second narrower rounded end and a second wider rounded end, wherein said protuberance is adapted to be (i) inserted into the at least one recess in the floor facing surface with the second narrower rounded end facing the first narrower rounded closed end, and (ii) pushed radially outwardly within the at least one recess, and wherein the outer wall further defines an exterior neck and comprises a third side section extending from the second narrower rounded end toward the exterior neck, a fourth side section extending from the second narrower rounded end toward the exterior neck, a fifth side section extending from the exterior neck toward the second wider rounded end, and a sixth side section extending from the exterior neck toward the second wider rounded end, wherein said third side section and said forth side section diverging from each other as they extend from the second narrower rounded end, and said fourth side section and fifth side section diverge from each other as they extend from the exterior neck; and c) an adapter clip having an exterior beveled wall adapted to be received within said at least one recess in the floor facing surface of the drive plate, said adapter clip having an interior aperture with an interior beveled wall, wherein said interior beveled wall of the aperture has an interior neck matching the exterior neck of the protuberance, said aperture adapted to receive the protuberance such that the interior wall of the aperture engages the outer wall of the protuberance, and wherein said protuberance and said adapter clip are adapted to be inserted together into the at least one recess in the floor facing surface with the second narrower rounded end facing the first narrower rounded closed end.

18. The apparatus of claim 17 wherein the adapter clip and protuberance are adapted to be pushed radially outwardly toward the first narrower rounded closed end causing the inner wall, the outer wall and the adapter clip to cooperate to secure the attachment plate to the drive plate.

* * * * *